US005797197A

United States Patent [19]

Alday

[11] Patent Number: 5,797,197

[45] Date of Patent: Aug. 25, 1998

[54] CARPET DRYER

[76] Inventor: Marcelino G. Alday, 2186 Bikini Ave., San Jose, Calif. 95122

[21] Appl. No.: 598,118

[22] Filed: Feb. 7, 1996

[51] Int. Cl.[6] ..... F26B 9/00

[52] U.S. Cl. ..... 34/618; 34/90; 34/60; 34/444

[58] Field of Search ..... 34/444, 618, 90, 34/60, 92; 15/316.1, 405

[56] References Cited

U.S. PATENT DOCUMENTS 3,774,262 11/1973 Anthony et al. ..... 15/322
5,048,202 9/1991 Shero ..... 34/618
5,174,048 12/1992 Shero ..... 34/444
5,208,940 5/1993 London et al. ..... 15/345
5,257,467 11/1993 White ..... 34/618

*Primary Examiner*—John M. Sollecito
*Assistant Examiner*—Dinnatia Doster
*Attorney, Agent, or Firm*—The Kline Law Firm

[57] ABSTRACT

A mobile carpet dryer that includes a blower unit that forces heated air onto the carpet. The dryer further includes a vacuum unit that draws water out of the carpet to greatly speed the drying process. The blower unit and the vacuum unit are mounted in a wheeled housing to provide easy portability of the dryer.

4 Claims, 5 Drawing Sheets

CARPET DRYER

FIELD OF THE INVENTION

The present invention relates generally to carpet care products, and more particularly is a carpet dryer with a drying unit to blow heated air and a vacuum unit to collect water.

BACKGROUND OF THE INVENTION

Most current day dwellings include at least some area of wall-to-wall carpeting. Simply from the nature of their installation, these carpets must be cleaned in place. The common method of cleaning is to shampoo the carpets. The problem that then arises is drying the carpets.

Due to the large amounts of water that can be absorbed by carpets and their underlying pads, the carpets can take a great deal of time to dry. If left to simply air dry, the carpets can remain wet for days. Current art methods of hastening the drying process are generally limited to using a fan to force air across the carpet, or as an improvement, a heater with a fan to force heated air across the carpet.

The limitations to the prior art methods are that large fans are not generally very mobile. Usually, a fan will be left in one position until the immediately surrounding area is dry, and then moved.

A further shortcoming of the prior art is that there is no method of drawing the water out of the carpet so that it may be dried faster.

OBJECTS, SUMMARY, AND ADVANTAGES OF THE INVENTION

Accordingly, it is an object of the present invention to provide a means of rapidly drying a carpet.

It is a further object of the present invention to provide a mobile carpet dryer.

It is a still further object of the present invention to provide a carpet dryer that has a heated air blower, and also has a vacuum means to draw water from the carpet.

In summary, the present invention is a mobile carpet dryer. The dryer includes a blower unit that forces heated air onto the carpet. The dryer further includes a vacuum unit that draws water out of the carpet to greatly speed the drying process. The blower unit and the vacuum unit are mounted in a wheeled housing to provide easy portability of the dryer.

An advantage of the present invention is that it greatly speeds the carpet drying process.

Another advantage of the present invention is that it provides a device that can be easily moved by the user.

A still further advantage of the present invention is that the device uses both forced air drying and vacuuming to dry the carpet.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

The present invention is a mobile carpet dryer 1. The dryer 1 includes a blower unit 16 that forces heated air onto the carpet, and a vacuum unit 34.

Figure 5:
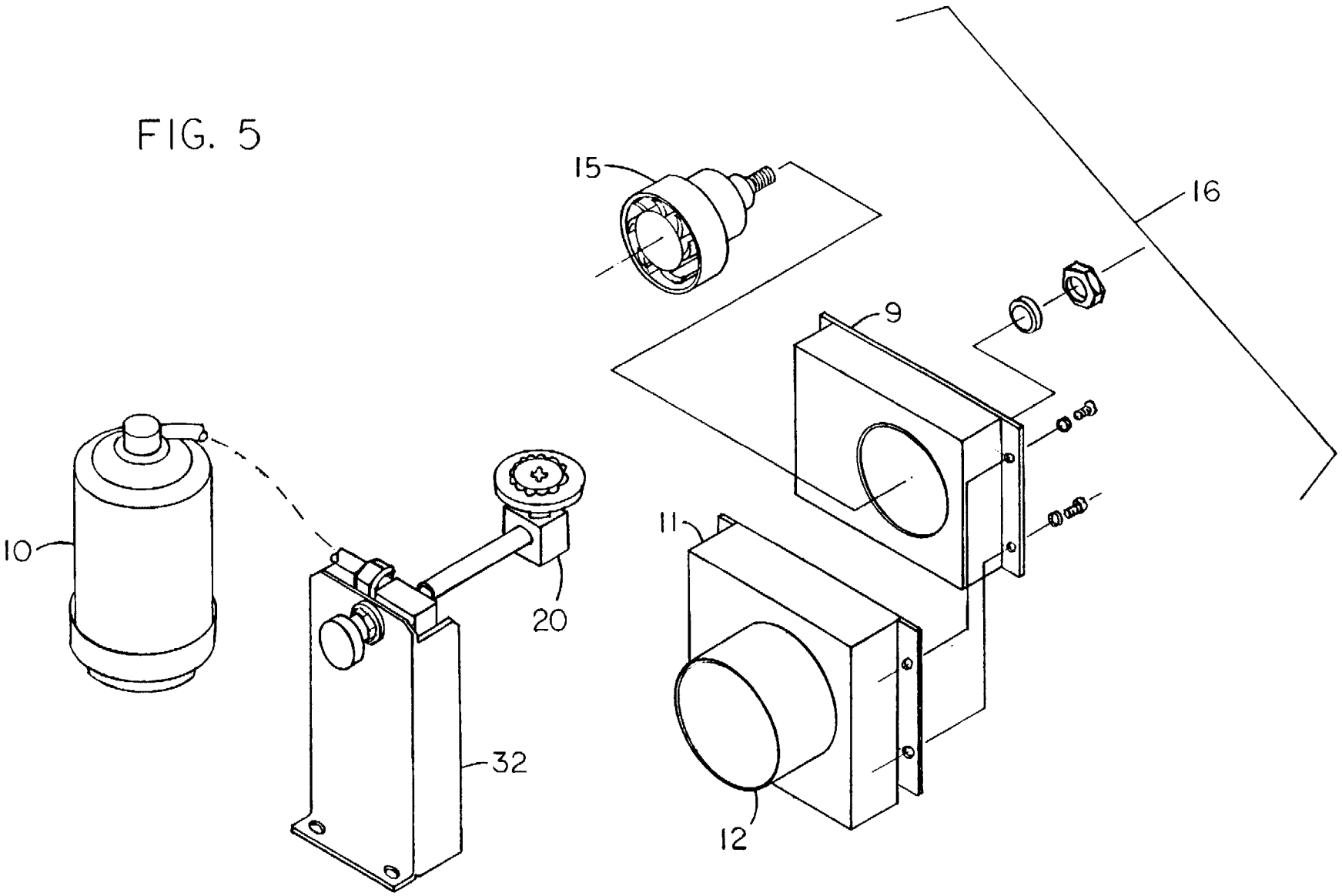
FIG. 5 is an exploded view of the heater and blower units.

The blower unit 16, shown in detail in FIG. 5, includes a rear housing 11 and a front housing 9. Air is heated by a heating means, usually a burner 20, although electric and other heating means could also be utilized. The burner 20 is mounted on a burner stand 32, and is supplied with fuel from a tank 10. In a preferred embodiment, the fuel utilized is propane. The burner 20 is mounted so that it is surrounded by a cylinder 12 on the back side of the rear housing 11. A fan unit 15 is fixed in the front housing 9. The front housing 9 includes an open bottom side that is in communication with a first louvered opening 31 (see FIG. 3).

Figure 1:
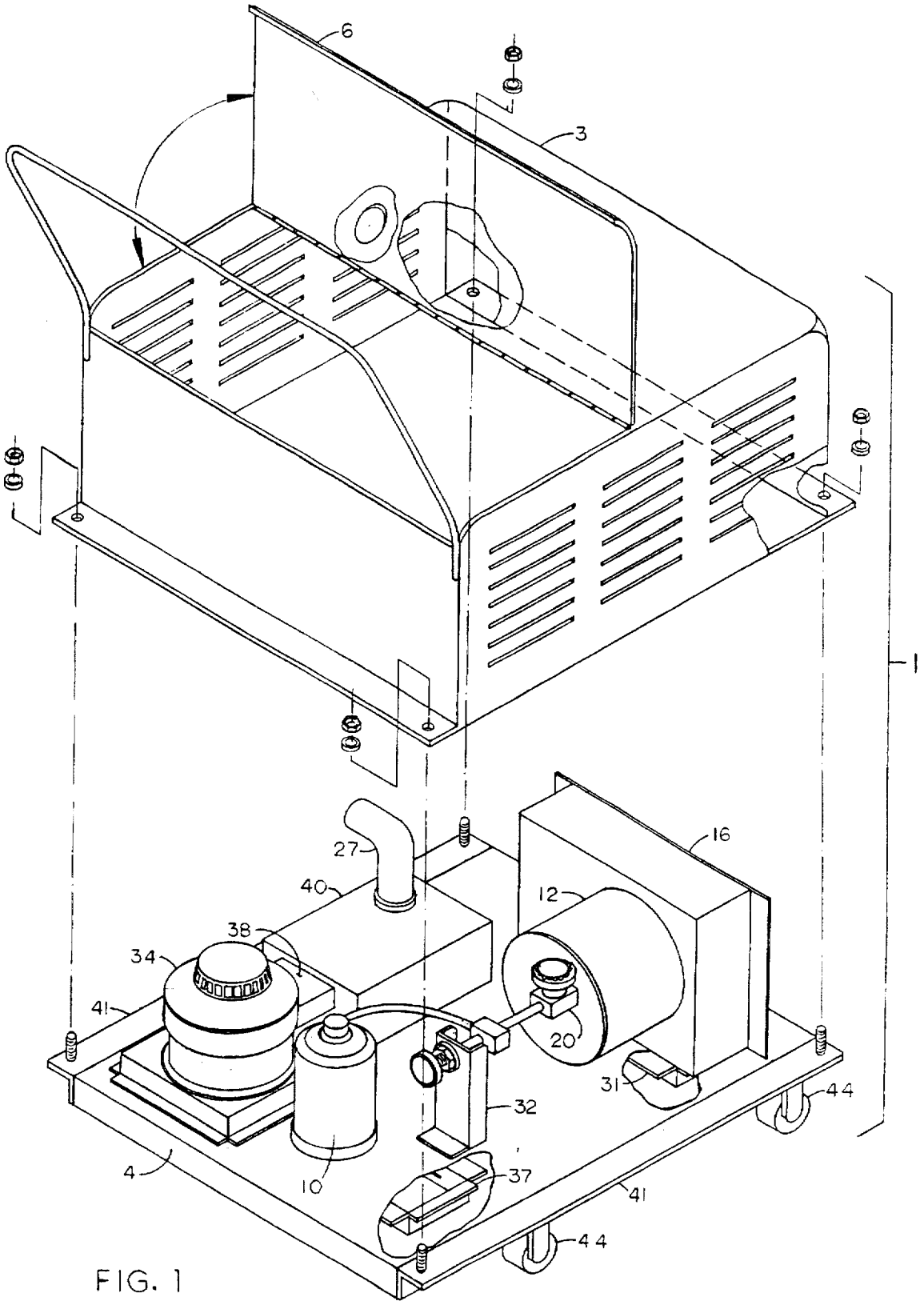
FIG. 1 is an exploded perspective view of the dryer of the present invention.
Figure 2:
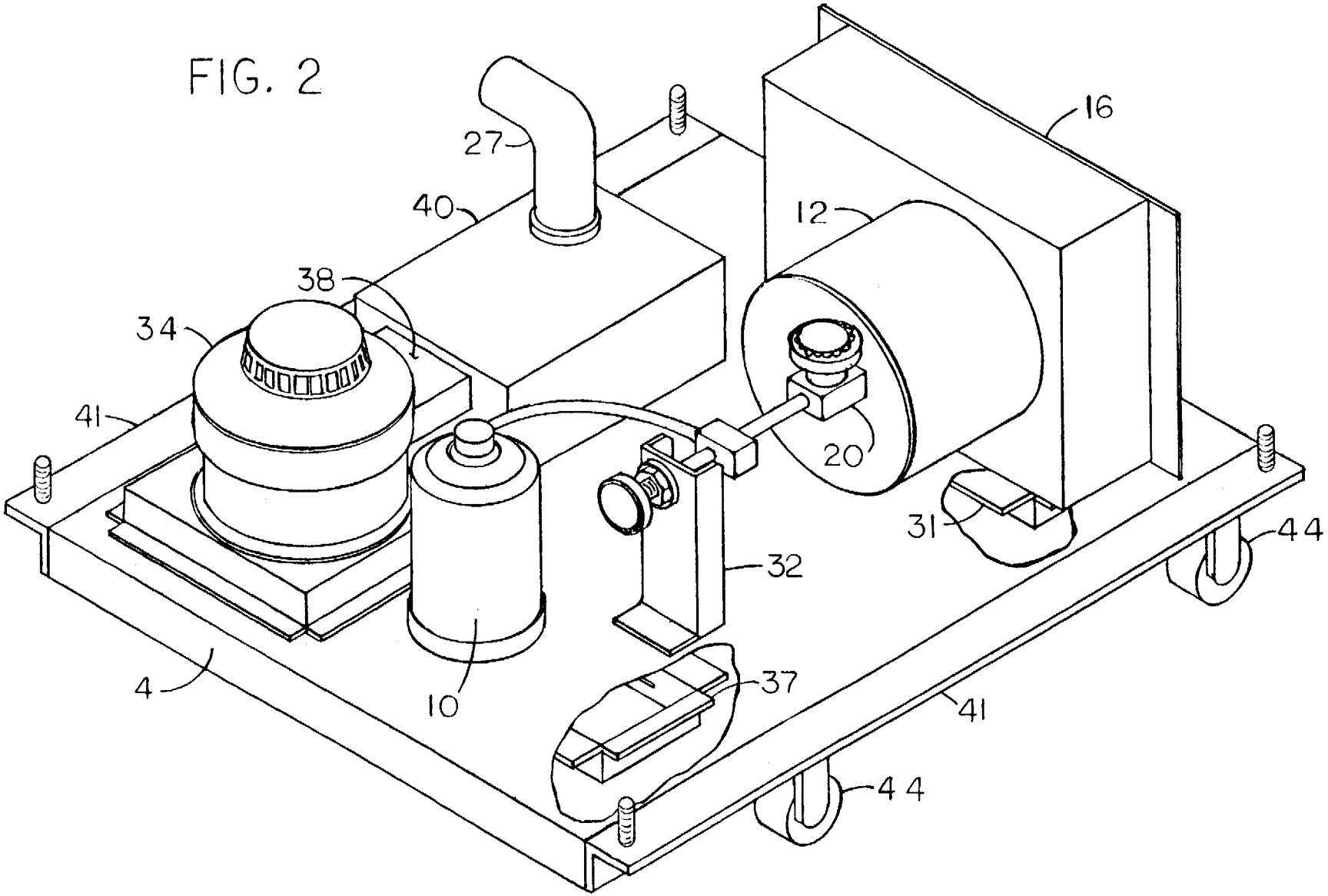
FIG. 2 is a partially broken view of the interior of the dryer.
Figure 3:
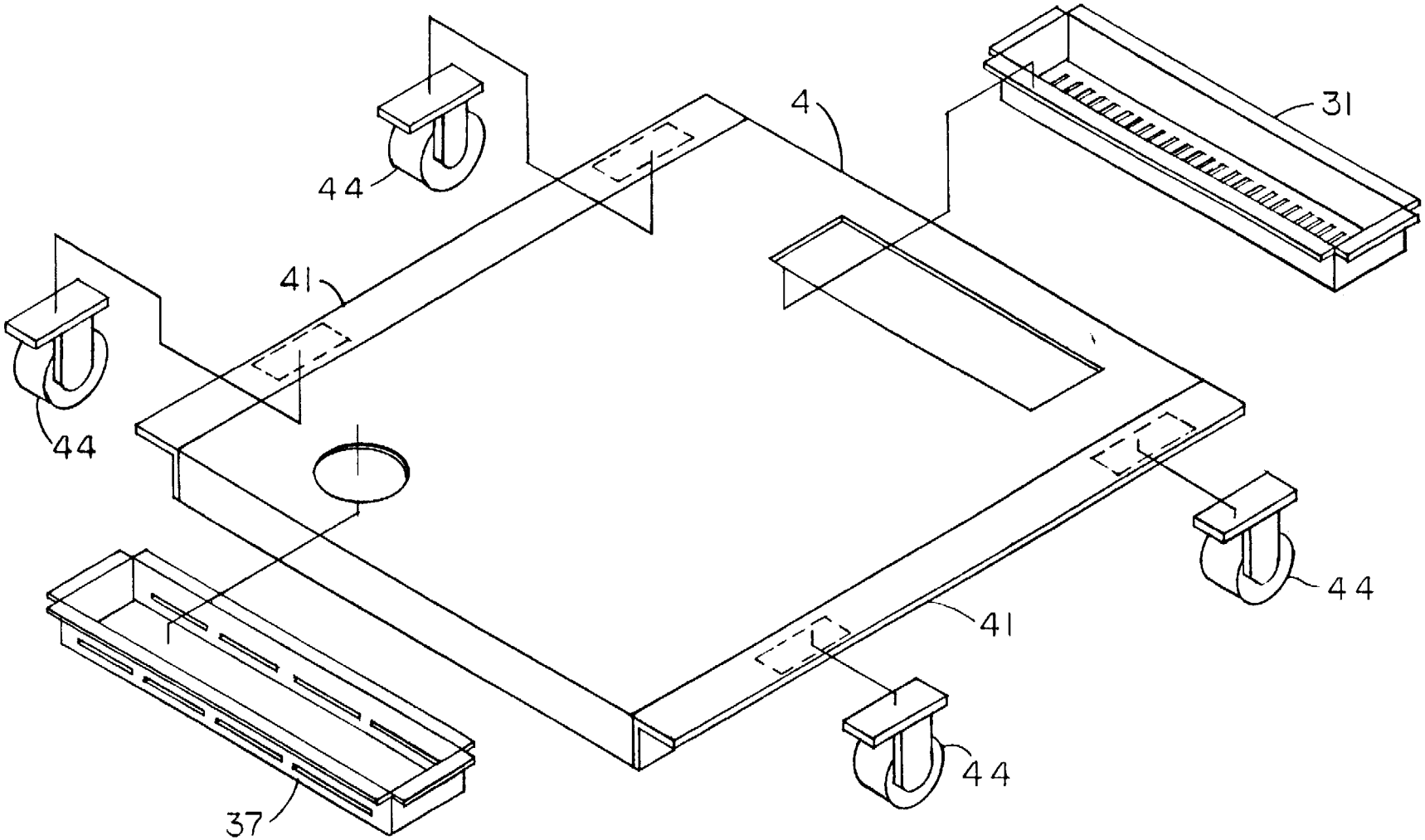
FIG. 3 shows an exploded view of the floor of the housing of the dryer.
Figure 4:
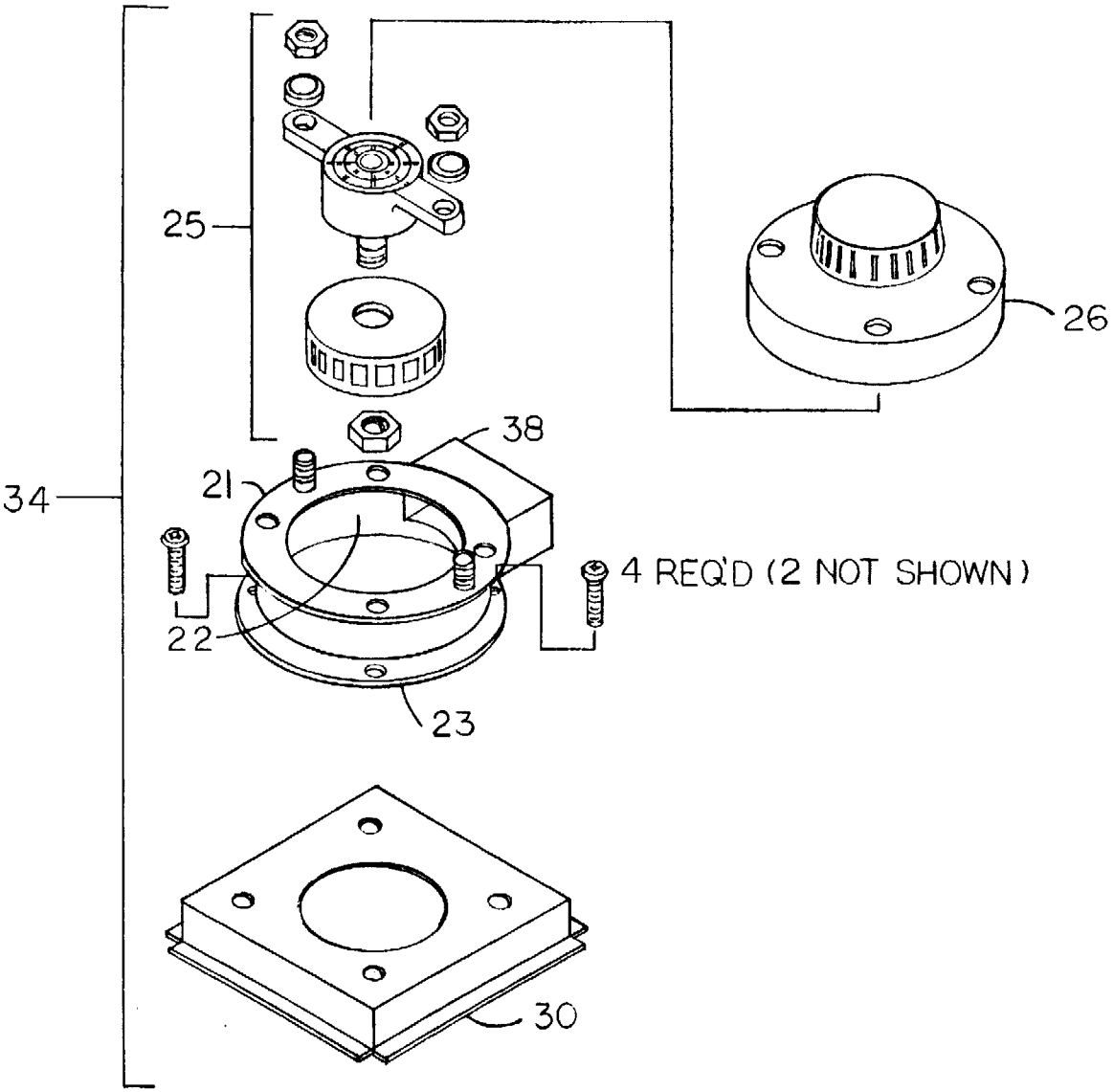
FIG. 4 is an exploded view of the vacuum assembly.

The vacuum unit 34 is shown in detail in FIG. 4. The vacuum unit 34 is mounted on a vacuum stand 30 and covered by a vacuum cover 26. The vacuum unit includes a motor 25 and a manifold that is formed from a top flange 21, a middle cylinder 22, and a bottom flange 23. An opening in the vacuum base is in communication with a second louvered opening 37 (see FIG. 3). An outlet 38 of the vacuum 34 is connected to a recovery tank 40. The recovery tank 40 includes an exhaust vent 27.

To provide the dryer 1 with mobility, the components are mounted on a wheeled base 4, shown in detail in FIG. 3. The base 4 includes a flange area 41 on each side to accommodate mounting of the wheels 44. As mentioned above, the base 4 also includes two louvered openings 31 and 37. A cover 3 with a handle is mounted on the base 4 to protect the components. The handle provides a user with a convenient means to propel the dryer 1. The cover 3 includes an access panel 6 with a vent for the exhaust vent 27 of the recovery tank 40.

Operation of the dryer 1 is as follows:

Although each unit can of course be operated individually, generally the user activates both the blower unit 16 and the vacuum unit 34. The fan unit 15 of the blower 16 draws air heated by the heating means 20 through the cylinder 12. The heated air is forced out through the first louvered opening 31 onto the carpet.

The vacuum unit 34 draws moist air in through the second louvered opening 37, and deposits the water-laden air into the recovery tank 40. Air is vented through the exhaust vent 27 so that excessive pressure is not built up within the recovery tank 40.

The user moves the dryer 1 about the subject carpet until the carpet is dried to the user's satisfaction. The combination of forced heated air and vacuum removal of moisture greatly speeds the drying process.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A carpet dryer comprising:

a blower unit that forces heated air onto a subject carpet, said blower unit comprising a fan unit and a heating means, a vacuum unit that draws water out of the carpet and deposits the water into a recovery tank, a base comprising wheels, a first opening that allows said blower unit to blow air onto the carpet, and a second opening that allows the vacuum to draw water out of the carpet into a recovery tank including a venting means, and a means for a user to grasp to move the dryer; wherein said fan unit of said blower draws air heated by the heating means through a cylinder, and then forces said heated air out through said first opening onto the carpet, said vacuum unit draws water in through said second opening, and deposits said water into said recovery tank.

2. The carpet dryer of claim 1 wherein:

said heating means is a gas burner, and said blower unit includes a fuel source.

3. The carpet dryer of claim 2 wherein:

said fuel source is propane.

4. The carpet dryer of claim 1 wherein:

said vacuum unit comprises a motor and a manifold that is formed from a top flange, a middle cylinder, and a bottom flange.

* * * * *